US005427420A

United States Patent [19]

Moore

[11] Patent Number: 5,427,420

[45] Date of Patent: Jun. 27, 1995

[54] LATCHBOLT ASSEMBLY, WITH FUSIBLY-ACTUATED DEADLOCKING

[75] Inventor: Walter G. Moore, Half Moon Bay, Calif.

[73] Assignee: Schlage Lock Company, San Francisco, Calif.

[21] Appl. No.: 179,217

[22] Filed: Jan. 10, 1994

[51] Int. Cl.[6] ..... E05C 1/12

[52] U.S. Cl. ..... 292/169; 292/92; 292/DIG. 66

[58] Field of Search ..... 292/169, 167, 92, 335, 292/153, 169.14, DIG. 66; 49/7, 8; 70/DIG. 10

[56] References Cited

U.S. PATENT DOCUMENTS

| | | | |
|---|---|---|---|
| 1,086,126 | 2/1914 | Berry | 49/8 |
| 2,776,158 | 1/1957 | Unetic et al. | 292/153 X |
| 3,144,266 | 8/1964 | Schmid et al. | 292/153 X |
| 3,300,240 | 1/1967 | Tornoe et al. | 292/1.5 |
| 3,353,858 | 11/1967 | Neary et al. | 292/169.14 X |
| 3,811,717 | 5/1974 | Floyd et al. | 292/DIG. 66 X |
| 4,012,066 | 3/1977 | Salvatore | 292/341.13 |
| 4,065,164 | 12/1977 | Bartels | 292/347 |
| 4,183,565 | 1/1980 | Allemann | 292/163 |
| 4,453,753 | 6/1984 | Fayerman et al. | 292/348 |
| 4,653,787 | 3/1987 | Fang | 292/169.14 X |
| 4,709,950 | 12/1987 | Zortman | 292/92 |
| 4,714,285 | 12/1987 | Langham . | |
| 4,726,613 | 2/1988 | Foshee | 292/167 |
| 4,824,150 | 4/1989 | Smith et al. | 292/92 |
| 5,257,837 | 11/1993 | Bishop | 292/1.5 |

*Primary Examiner*—Rodney M. Lindsey

*Attorney, Agent, or Firm*—Robert F. Palermo; Bernard J. Murphy

[57] ABSTRACT

A link, used to allow retraction of the latchbolt against the bias of a spring, is formed of a fusible material to insure that, in the presence of intense heat, the link will melt and will no longer override a deadlocking pawl to allow the latchbolt to be withdrawn.

8 Claims, 3 Drawing Sheets

LATCHBOLT ASSEMBLY, WITH FUSIBLY-ACTUATED DEADLOCKING

BACKGROUND OF THE INVENTION

This invention relates to door latching means, and, more particularly, to a latch-bolt assembly, having a fusibly-actuated deadlocking for use, especially, in a fire-rated door.

To reduce the likelihood that fire will increase and/or spread, it is necessary to insure that a closed, fire-rated door remains closed by retaining the latchbolt thereof in its door-latching disposition. In the prior art, fusibly-actuated deadlocking arrangements are known. The known, fusible systems, notwithstanding their acceptable functionings, do have undesirable limitations. One such fire safety door latch is exemplary of prior art systems. In this patented arrangement, it is necessary to have a plate, with a hole formed therein, confronting the innermost portion of the latchbolt, and that portion of the latchbolt must have another hole formed therein, so that a fusible link or plug can be fitted into the two holes. Besides this required machining, for the fusible plug, it would appear that the plug-bearing latchbolt would serve as a heat sink and inordinately delay the fusible release of the plug. Another prior art arrangement discloses a cable connected to a door-knob crank and to a latchbolt, spring-loaded link, with the cable displaced from linearity by a fusible roller. In another fusible arrangement, a fusible pin, set into an inner end of the latchbolt, holds a spring-loaded dowel-like element within a transverse bore in the latchbolt. Upon melting of the pin, the dowel-like element projects from the latchbolt and enters a bore, provided therefor, in the casing of the assembly.

The aforesaid, and similar prior art arrangements, for fusibly deadlocking a latchbolt, are not without merit. However, they are bulky, or complicated, or expensive to manufacture and service, and require extraneous parts and components for the fabrication thereof.

What has long been needed is a fusibly-actuated deadlocking arrangement which is of simple, straightforward construction and, most significantly, warrants no extraneous elements for construction thereof, i.e., a fusibly-actuated deadlocking arrangement, for a latchbolt assembly, which requires no more parts and/or components than a standard, off-the-shelf, non-fusibly deadlocking, latchbolt assembly.

The foregoing illustrates limitations known to exist in present devices and methods. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the invention, this is accomplished by a latchbolt assembly, with fusibly-actuated deadlocking, including a housing and a latchbolt slidably engaged with the housing; first means disposed within said housing, and engaged with said latchbolt, for biasing said latchbolt outwardly of said housing; and linkage means, coupled to said latchbolt, and reciprocative relative to said housing, for disabling a deadlocking pawl which prevents prying open of said latchbolt into said housing; wherein said linkage means is fusible.

The foregoing and other aspects will become apparent from the following detailed description of the invention when considered in conjunction with the accompanying drawing figures.

BRIEF DESCRIPTION OF THE DRAWING FIGURES

Figure 3:
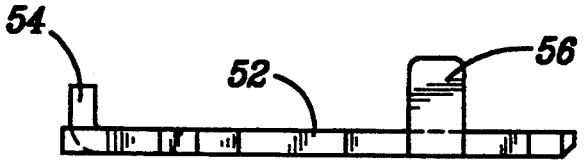
Figure 4:
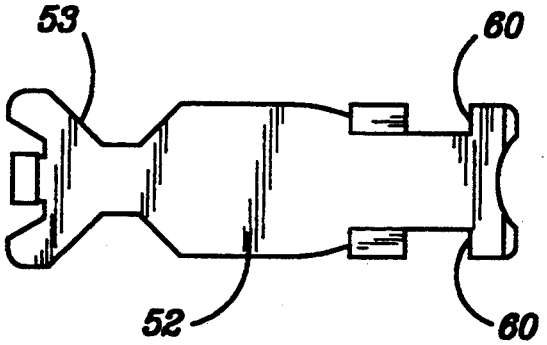
Figure 5:
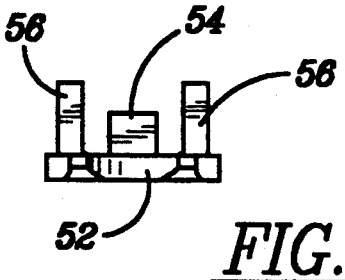
Figure 6:
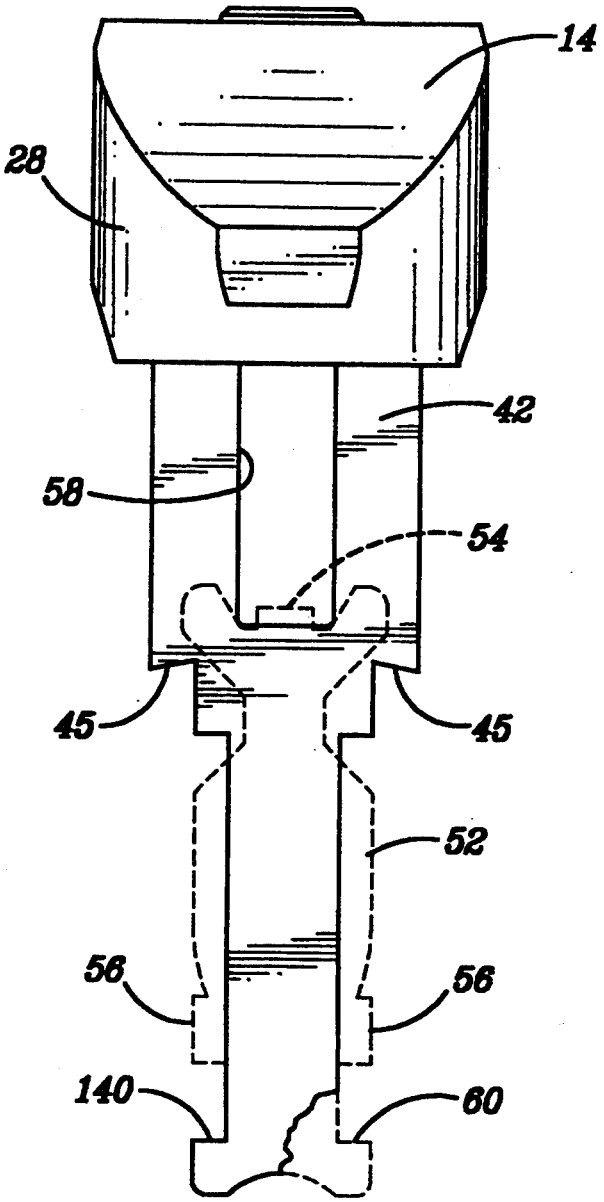

FIGS. 3, 4, and 5 are plan, side elevation, and end views of the novel, fusible link employed in the latchbolt assembly; and FIG. 6 is a plan view of the latchbolt, partly foreshortened for clarity of understanding, in full line, and the novel, fusible link in operative relationship with the latchbolt, in phantom outline.

DETAILED DESCRIPTION

Figure 2:
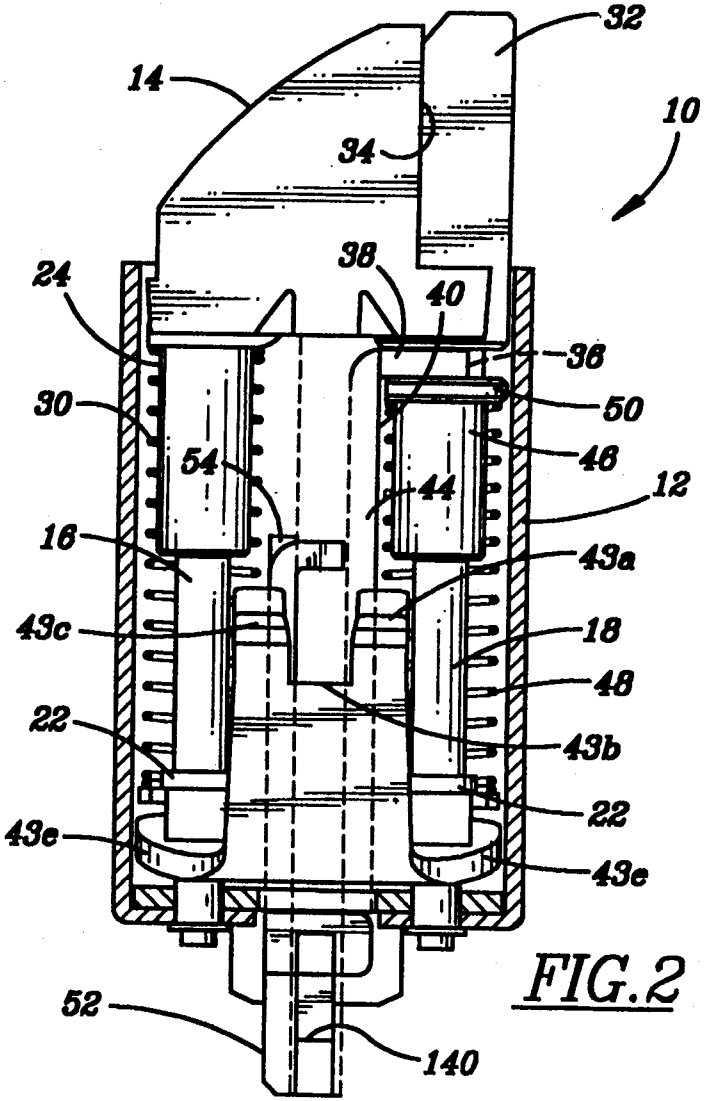
FIG. 2 is an illustration, like that of FIG. 1, showing the novel assembly rotated ninety degrees of arc, i.e., a view from the right-hand side of FIG. 1.
Figure 1:
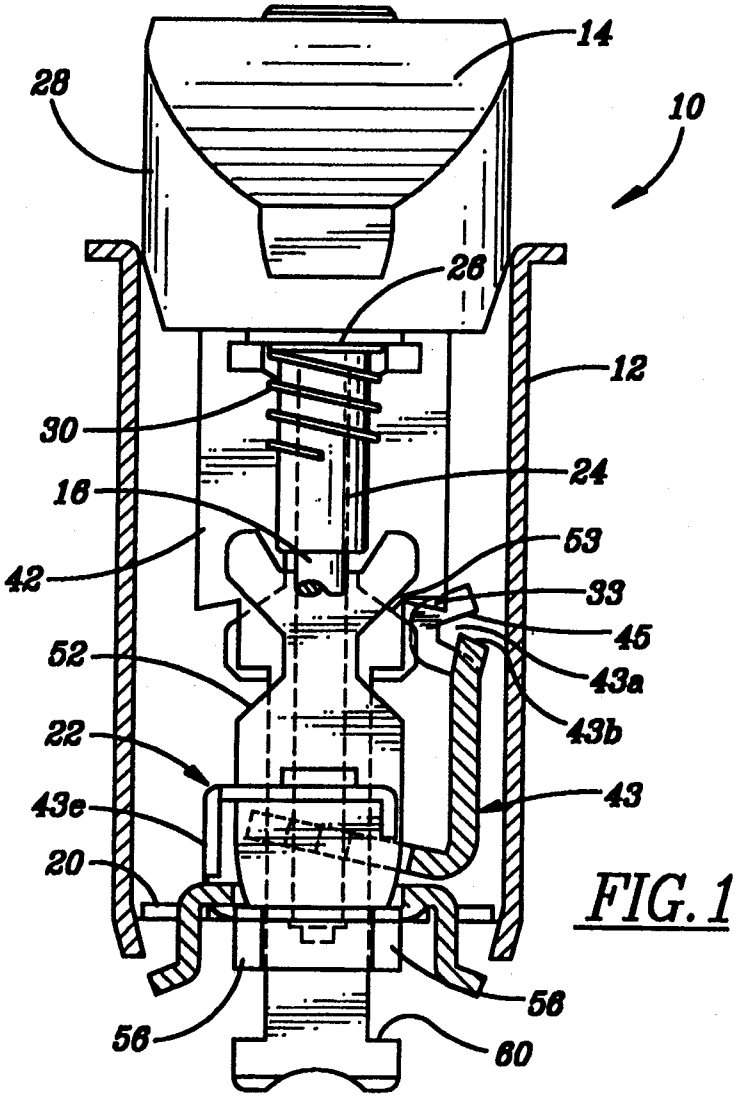
FIG. 1 is an illustration, partly cross-sectioned, of an embodiment of the latchbolt assembly, according to the invention.

As shown, particularly in FIGS. 1 and 2, the latchbolt assembly 10, according to an embodiment thereof, comprises a housing 12 of generally cylindrical form, and a latchbolt 14 slidably engaged therewith. Ends of rods 16 and 18 are fixed in an end plate 20 and penetrate a spring seat 22 set within the housing 12 and adjacent an end thereof. Rod 16 is slidably received in a cylindrical tube 24. Tube 24 has a disc 26 fixed thereto which is set against an innermost of the head 28 of the latchbolt 14. A compression spring 30 envelops the tube 24 and rod 16; it bears, biasingly, against the spring seat 22 and the disc 26 to urge the latchbolt 14 outwardly relative to the housing 12.

A plunger 32 is slidably engaged with a flattened 34 of the head 28 of the latchbolt 14. Inboard of the housing 12, the plunger 32 has an annular recess 36. The recess 36 is engaged by a bifurcation 38 formed in a right-angular portion of a cam plunger 40. The latchbolt 14 comprises a flat bar 42 which extends into the housing 12 from the head 28 with which it is integral. The cam plunger 40 has an elongate portion 44, extending into the housing 12, from the bifurcation 38. Portion 44 is slidably engaged with the bar 42 of the latchbolt 14 and has a cam 33 for operating deadlocking pawl 43 through cam follower **43*a*. Deadlocking pawl 43 has symmetrical ears 43*e* disposed behind spring seat 22 and, in one embodiment of the invention, a spring (not shown) is provided between seat 22 and ears 43*e* to bias deadlocking pawl 43 toward bolt bar 42. Thus, when the door is closed and plunger 32 is held in the retracted position, cam surface 33 of cam plunger 40 is retracted to permit engagement between pawl deadlocking surface 43*b* and bolt bar tooth 45 in response to the bias provided by the spring (not shown). This permits installation of the latch with the deadlocking pawl either on the top or the bottom. Plunger 32 has an innermost tubular end 46 which slidably receives the rod 18. Another compression spring 48 envelops end 46 and rod 18; it too bears, biasingly, against the spring seat 22 and an annulus 50 formed about the end 46, to urge the plunger 32 outwardly relative to the housing 12**.

In another embodiment (not illustrated) two deadlocking pawls 43 are provided, one each on top and bottom of the latch 10. By providing a bolt bar 42, cam plunger 40, and link 52 with top-to-bottom symmetry; no matter which side of latch 10 is mounted upwardly, the top deadlocking pawl 43 is biased by gravity to engage tooth 45 of bolt bar 42. The gravity bias eliminates the necessity for biasing springs as in the single pawl embodiment. The two pawl embodiment assures that the deadlocking feature will function even at temperatures which would destroy the biasing power of the springs.

The novel link 52, shown in isolation in FIGS. 3 and 5, is fusible. In this embodiment, the link 52 is formed of a meltable plastic but any low melting point material having desired mechanical properties may be used. Link 52 has a tab 54 projecting therefrom adjacent one end of the link, and a pair of lugs 56 also projecting therefrom adjacent the opposite end thereof. As shown in FIG. 6, the flat bar 42 of the latchbolt 14 has a slot 58 formed therein. Tab 54 engages the innermost end of the slot 58 so that, if latchbolt 14 is pushed into the housing when the door is closed, link 52 will not move and will not disable the anti-pry feature of the latchbolt assembly. Manipulative mechanism (not shown) engages link retractors 60 at the aforesaid opposite end of the link 52 and simultaneously bolt bar retractors 140 to cause the latchbolt 14 to be retracted into the housing 12 against the bias of the spring 30. The lugs 56 are arranged astride the innermost end of the cam plunger 40 for guiding the latter in reciprocable sliding thereof along the bar 42.

Link 52 provides an override function for the anti-pry feature of the latchbolt assembly 10. When the door is closed, the latchbolt 14 protrudes into a latch plate in the door frame to latch the door closed; but, since the hole in the latch plate has a flat side which prevents extension of plunger 32 into the hole along with latchbolt 14, plunger cam 33 is held in a retracted position and thereby enables deadlocking pawl 43 by also retracting cam plunger 40. Pawl cam follower **43*a* rides down plunger cam 33 until pawl deadlocking 43*b* engages latchbolt bar tooth 45 to prevent unlatching of the door by prying against latchbolt 14**.

When the latch is operated by turning the spindle with a knob or lever, the latchbolt 14 is retracted by pulling against bolt bar retractors 140 and, at the same time, link retractors 60. As the link 52 retracts, its deadlock override cam 53 engages cam follower **43*c* and raises pawl 43 to disengage bar tooth 45 from pawl deadlocking 43*b* and thereby allows retraction of latchbolt 14**.

In the presence of intense heat, the link 52 will melt and will no longer release the latchbolt 14 from deadlocking pawl 43. Consequently, the closure (door, bulkhead, etc.) in which the latchbolt assembly 10 is installed will be securely deadbolted. The closure manipulative/operating mechanism will be ineffective, for re-opening of the closure, as the override feature, in which fusible link 52 is essential, shall have melted.

One additional embodiment, although less desirable than those embodiments permitting installation without regard to orientation of deadlocking pawl 43, provides a latchbolt bar, a cam plunger, and a deadlocking pawl override link, all without top-to-bottom symmetry, and a deadlocking pawl on top only. This requires separate latchbolt assemblies for different door handings. In addition to greater inventory costs, it also adds the potential for mistakes in installation which may render the deadlocking pawl inoperative.

Latchbolt assemblies, such as assembly 10, commonly have a link of some nature for retracting the latchbolt, and commonly as well the same is of metal fabrication. To effect fusible deadlocking of such assemblies, as noted in the foregoing, extraneous parts and components are incorporated thereinto, as is seen in the prior art. It is a first teaching of this application to employ no extra assembly parts, pieces, components and such in the fabrication of a fusibly-actuated deadlocking for a latchbolt assembly. The deadlocking is assured by the expedient of forming a heretofore high melting point metal, latchbolt deadlock override link, i.e., link 52, of fusible material, allowing the typical latchbolt biasing spring to extend the latchbolt, irretrievably, into a locking disposition, and deadlocking it in that position by means of the anti-pry deadlocking pawl 43.

While I have described my invention in connection with three specific embodiments thereof it is to be clearly understood that this is done only by way of example and not as a limitation to the scope of the invention, as set forth in the purposes thereof and in the appended claims.

What is claimed is:

1. A latchbolt assembly for a door in a door jamb comprising:

a substantially cylindrical housing with a faceplate mounted thereon;

a latchbolt slidably engaged with said housing and extendible therefrom through said faceplate;

a plunger extendible through said faceplate adjacent said latchbolt and operably engaged with means, within said housing, for preventing prying of said latchbolt when the door is closed in the door jamb;

means for biasing said latchbolt and said plunger to an extended position from said housing; and linkage means, within said housing and coupled to said latchbolt, for overriding said means for preventing prying of said latchbolt when said latchbolt is being retracted by operation of a door knob spindle, wherein said linkage means is fusible.

2. The latchbolt assembly of claim 1, wherein the means for preventing prying of said latchbolt comprises a deadlocking pawl, a latchbolt bar tooth, and a cam on said plunger for enabling locking contact between said deadlocking pawl and said latchbolt bar tooth when said plunger is pushed into said housing.

3. The latchbolt assembly of claim 2, wherein said deadlocking pawl is biased toward locking contact with said latchbolt bar tooth.

4. The latchbolt assembly of claim 3, wherein said deadlocking pawl is biased by gravity toward said latchbolt bar tooth.

5. The latchbolt assembly of claim 3, wherein said deadlocking pawl is biased by one or more springs toward said latchbolt bar tooth.

6. The latchbolt assembly of claim 1, wherein the means for biasing said latchbolt and said plunger comprises a spring seat in said housing supporting a spring for said latchbolt and a spring for said plunger.

7. The latchbolt assembly of claim 1, wherein said linkage means for overriding said means for preventing prying of said latch bolt comprises a bar having a tab and lugs for maintaining alignment with a latchbolt bar, retractor ears, and a deadlock override cam.

8. The latchbolt assembly of claim 1, wherein said latchbolt has a bar which projects into said housing, said linkage means comprises a plastic link, and said link and said bar have means cooperative for mechanically linking said bar and said link.

* * * * *